United States Patent [19]

Moon

[11] 4,217,055

[45] Aug. 12, 1980

[54] DAISY WHEEL PRINTER WHICH ACCOMMODATES DIFFERENT PRINT WHEEL FONTS

[75] Inventor: S. David Moon, Los Altos, Calif.

[73] Assignee: Qume Corporation, San Jose, Calif.

[21] Appl. No.: 910,954

[22] Filed: May 30, 1978

[51] Int. Cl.[3] ..... B41J 1/30

[52] U.S. Cl. ..... 400/144.2; 400/166; 400/171

[58] Field of Search ..... 400/144.2–144.4, 400/166, 171, 306

[56] References Cited

U.S. PATENT DOCUMENTS

| | | | |
|---|---|---|---|
| 3,659,275 | 4/1972 | Marshall | 364/200 |
| 3,991,868 | 11/1976 | Robinson et al. | 400/124 |
| 4,084,680 | 4/1978 | Deetz | 400/144.2 X |
| 4,118,129 | 10/1978 | Grundherr | 400/144.2 |

*Primary Examiner*—Paul T. Sewell

[57] ABSTRACT

A daisy wheel printer which accommodates different print wheel fonts has switchable ROMs each containing print position and instruction information for each character on an associated print wheel. The possible number of printing positions is substantially double the number of characters carried on a print wheel.

4 Claims, 7 Drawing Figures

FIG.—1
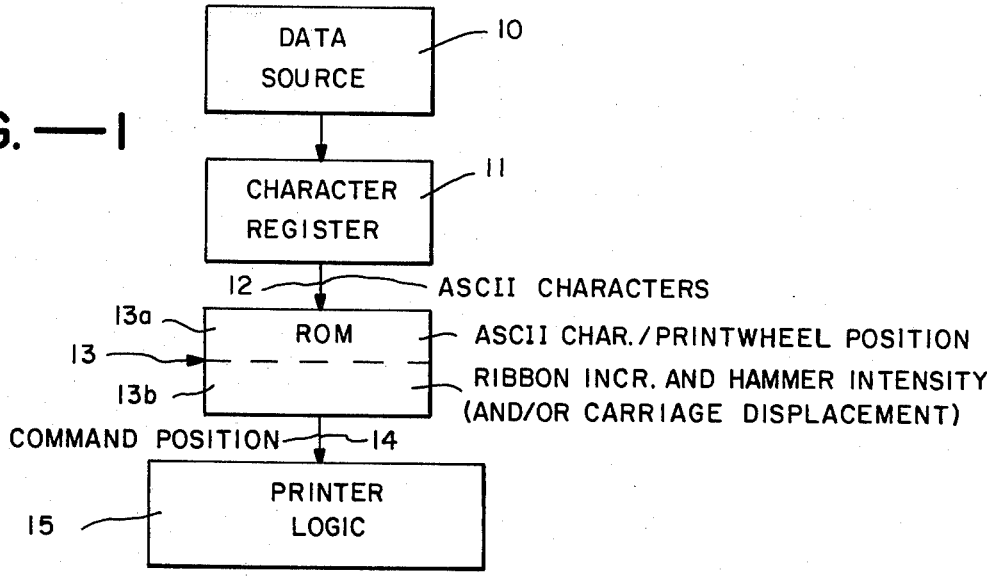
| DATA BIT | 8 | 7 | 6 | 5 | 4 | 3 | 2 | 1 |
|---|---|---|---|---|---|---|---|---|
| PRINTWHEEL POSITION AS RELATED TO ASCII CHAR. | 1 | 0 | 0 | 0 | 0 | 0 | 0 | 1 |
| ASSOCIATED PRINT INSTR. | X | 1 | 1 | 0 | 0 | 1 | 1 | 1 |
| | | HAMMER INTENSITY | | | RIBBON INCREMENT (CARRIAGE DISPLACEMENT) | | | |
(192 POSSIBLE)
FIG.—2
FIG.—3
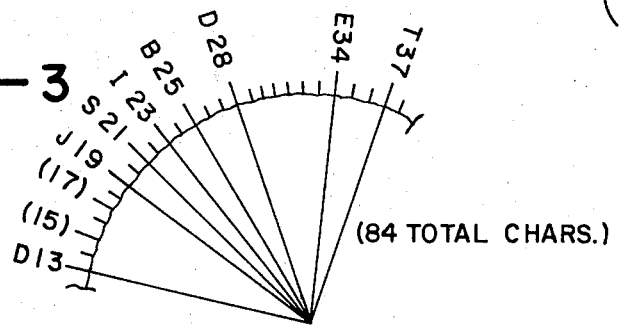
DOCUMENTARY PRINTWHEEL
(ACTUAL SIZE BUT EXPANDED ANGULARLY)
PROPORTIONAL SPACING UNITS
D—4
J—3
S—3
I—2
B—4
D—4
E—4
T—4
FIG.—4
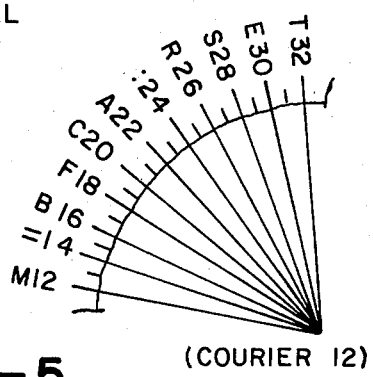
FIG.—5

DAISY WHEEL PRINTER WHICH ACCOMMODATES DIFFERENT PRINT WHEEL FONTS

BACKGROUND OF THE INVENTION

The present invention is directed to a daisy wheel printer which accommodates different type wheel fonts.

At the present time present daisy wheel type impact character printers are designed to accept substantially one basic type of print wheel character font. This is because the printer either by a read only memory or by supplementary externally programmed instructions must provide with each particular character font instructions as to the hammer intensity, ribbon increment and carriage displacement. The carriage displacement is especially important when proportional spacing is utilized.

One attempted solution which has been tried in the past where it was desired to use print wheels one of which has an English alphabet and the other an Arabic alphabet was a double size read only memory was provided with a toggle switch on the frame of the printer which would switch between either of the memories depending on which character font was being used, English or Arabic. Rather than using a switch it was also possible to cut or reconnect a jumper wire or for that matter merely to replace one ROM with another.

In the specific case of the Arabic alphabet the ROM utilized only even printing positions and left seven possible even character positions blank in order to provide for extra space larger than usual for adjacent Arabic characters.

However, all of the foregoind was done on the bases of 96 printing positions and, of course, this is a standard in the industry for the daisy wheels.

Because of the above 96 character print wheel standard and the associated 96 printing positions provided by the daisy wheel drive system of the printer, print wheel designers have been severely constrained.

In a copending application entitled "Rotary Print Wheel System" in the name of Willy J. Grundherr, Ser. No. 700,654, filed June 28, 1976, and now U.S. Pat. No. 4,118,129 there is described a print wheel system which includes a print wheel drive which is capable of 192 printing positions. This 192 printing position system has actually been used with a so-called "documentary print wheel" where in order to provide proportional spacing, odd printing positions as well as even were used. However, this so-called documentary printing wheel which is shown in FIG. 3 was never used in a switchable mode. On contrary, the use of the documentary system severely restricted the use of any other wheel on this particular printer.

As is apparent from the foregoing, the capability of a daisy print system where the print wheel may be driven to substantially double the number of printing positions as the typical maximum number of characters on the print wheel has never been fully utilized.

OBJECTS AND SUMMARY OF THE INVENTION

It is, therefore, an object of the present invention to provide an improved daisy wheel printer which accommodates different type wheel fonts.

It is another object of the invention to provide a printer as above where the available print positions are fully utilized in order to enhance the flexibility of the print wheel designer.

It is yet another object of the invention to provide a printer as above where print wheels with different type fonts can easily be changed without requiring extensive and expensive software reprogramming in order to define new character locations, hammer intensities and degrees of ribbon advancement.

In accordance with the above objects there is provided a daisy wheel type printer where the maximum number of characters on the wheel is limited by mechanical constraints. The daisy print wheel drive system, which intermittently moves the print wheel to printing positions, is capable of substantially double the number compared to the number of characters. A plurality of selectively replaceable print wheels each with a different type font is provided. A plurality of read only memories (ROMs) is uniquely associated with each one of the print wheels for storing printing position decoding information and for storing printing instructions associated with each of such characters. At least some of the printing positions which are utilized in one ROM are different from another ROM so that substantially more printing positions than the maximum number is utilized. Switching means enable a selected one of the ROMs corresponding to the associated print wheel placed in the printer.

BRIEF DESCRIPTION OF THE DRAWINGS

FIG. 1 is a block diagram of a printer system embodying the present invention;

FIG. 2 is a table useful in understanding the configuration of FIG. 1;

FIG. 3 is a diagrammatic view of a documentary print wheel which is old per se but can effectively be used in the context of the present invention;

FIG. 4 is a table useful in understanding the documentary print wheel of FIG. 3;

FIG. 5 is a diagrammatic view of a "Courier" print wheel which is old per se but is useful in understanding the effectiveness of the present invention;

DETAILED DESCRIPTION OF THE PREFERRED EMBODIMENT

Figure 6:
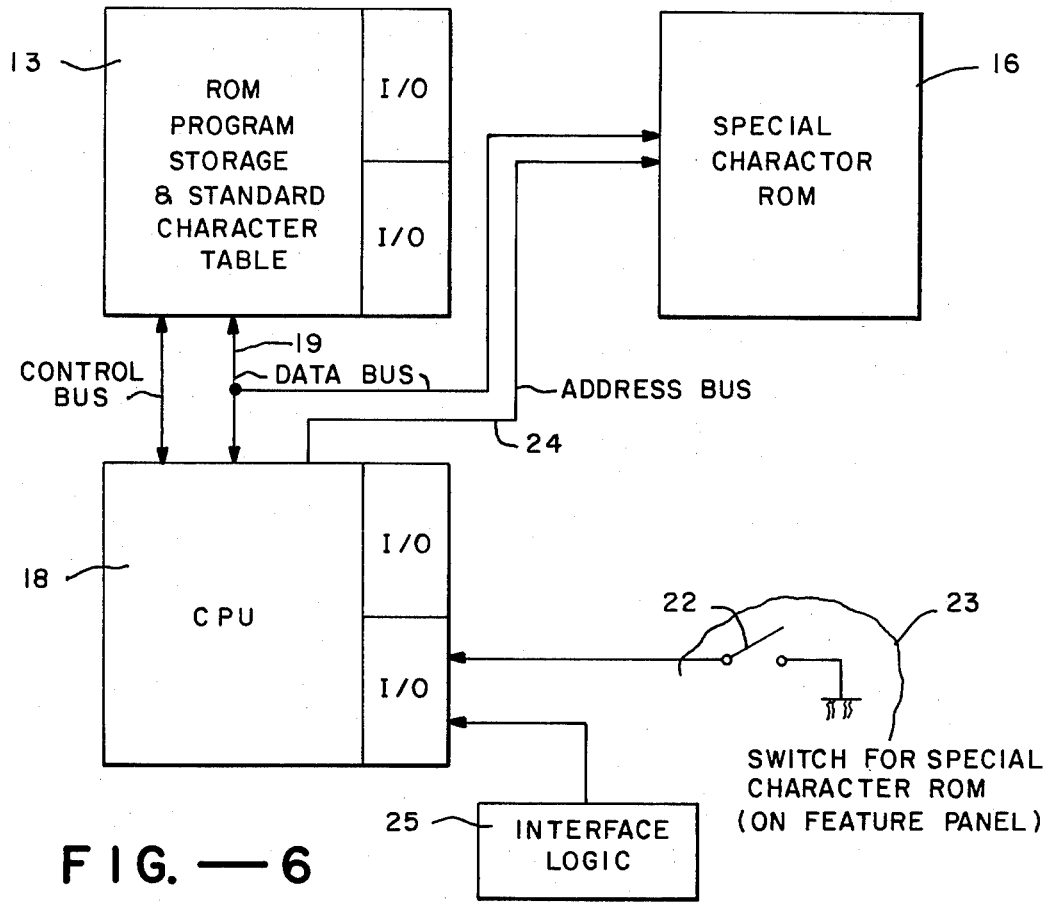
FIG. 6 is a block diagram of the logic circuitry embodying the present invention.

FIG. 1 in many respects illustrates a typical daisy wheel printer logic system as disclosed in the above copending application now U.S. Pat. No. 4,118,129 where a data source 10 interfaces with a character register 11 to provide an ASCII character code output on line 12 which in turn is connected to a ROM 13. Portion 13*a* decodes the ASCII characters into a relative print wheel location or position. For example, assuming the print wheel has 96 characters, which is the normal maximum number of characters on such wheel as discussed above, ROM 13*a* would decode the ASCII character to tell the print wheel to turn to, for example, its thirteenth character.

In addition, the ROM contains a portion 13*b* which contains associated information related to each specific character stored in the ROM such as ribbon increment, how far the ribbon should be advanced for each character, and also the proper hammer intensity for that character. In addition, carriage displacement which may be utilized in the case of proportional spacing, may be stored in the ROM instead of ribbon increment. Then the ribbon increment can be computed from the carriage displacement information. However, in the present invention which is preferably used with what the assignee terms its SPRINT 5 (trademark) printer, carriage displacement is provided by the external program.

The output of the ROM on line 14 is connected to the printer logic 15.

The table of FIG. 2 indicates the contents of ROM 13 where the bytes contain eight bits. A typical eight bit print wheel position which is related to a specific ASCII character is illustrated. Since there are 192 possible printing positions eight bits must be used. This is opposed to the normal seven bits in the 96 position printer. In addition, an associated print instruction would include three bits for hammer intensity and the other four bits are used in the preferred embodiment for ribbon incrementing but could be used for carriage displacement if desired.

The actual information of the table of FIG. 2 could include print wheel position information such as for the wheel of FIG. 3 which depicts, in representational form, a portion of a documentary print wheel where the letters and their relative character position (relative to the 192 possible) are illustrated. FIG. 4 shows the proportional spacing units relating to the size of the various characters. Such proportional spacing units are greater in number for D, B, O, E, T as reflected in FIG. 3 where the spokes are further apart. From a design standpoint they are made further apart by utilizing both even and odd print positions (with respect to the 192). FIG. 5 is a more typical print wheel termed "Courier" which utilizes just the even positions with the letters shown.

The block diagram of FIG. 6 illustrates the concept of the present invention. Rather than the single ROM 13 shown in FIG. 1 and as also illustrated in FIG. 6 there is a special character ROM 16. A central processing unit 18 is connected via a data bus 19 to the standard ROM and to the special character ROM. Input/output ports are provided. A switch 22 is provided on the feature panel 23 of the printer which may be actuated between its standard print wheel position and special print wheel position. When actuated it causes CPU 18 by means of data bus 19 to address the special character ROM 16 via address bus 24 and read the character information into the CPU instead of reading the character information from the standard character table in ROM 13. It should be mentioned parenthetically that standard ROM 13 also includes a program storage portion for overall operation of the printer. Thus in summary, the special character ROM 16 is actuated by the user activating switch 22 when they have placed the special character print wheel in the printer.

Figure 7:
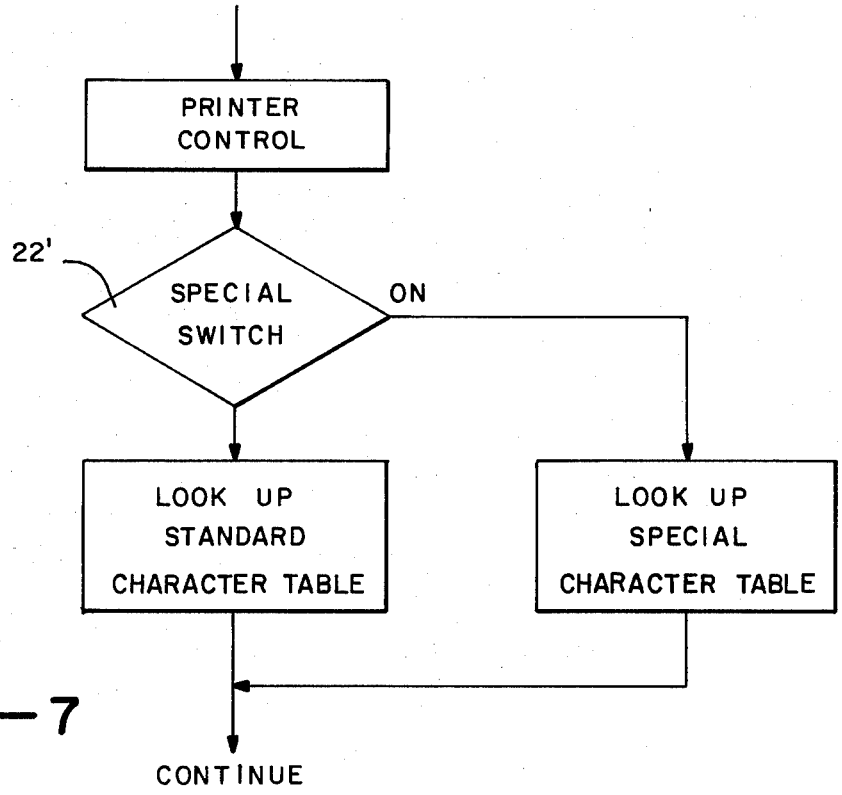
FIG. 7 is a flow chart which is helpful in explaining the operation of FIG. 6.

FIG. 7 illustrates a flow chart illustrating the operation of the activation of switch 22. Such switch is shown in the operational block 22' where when it is "off" a standard character table is looked up and when "on" the special character table is enabled.

Switch 22 could alternatively, of course, be activated by an associated computer.

Thus to summarize the present invention, it is useful to do so in the context of the documentary print wheel of FIG. 3 and the standard print wheel of FIG. 5. When a change is made from, for example, the standard print wheel to documentary a switch need merely be actuated rather than extensive reprogramming as needed in the prior art. Moreover, since the documentary print wheel contains odd printing positions as well as even, the full 192 printing position capacity of the printer can be utilized giving the print wheel designer greater flexibility. In general the ability to use both odd and even printing positions allows the designer to maximize the total number of characters on a print wheel at the same time maintaining even weight distribution. Print wheel design becomes especially difficult when standard alpha-numeric characters are mixed with special symbols. The technique of the present invention is of significant help in solving this design problem.

What is claimed is:

1. A daisy wheel type printer where the maximum number of characters on the wheel is limited by mechanical constraints but where the daisy print wheel drive system, which intermittently moves the print wheel to printing positions, is capable of substantially double the number of printing positions compared to said maximum number of characters said printer comprising: a plurality of selectively replaceable print wheels each with a different type font; a plurality of read only memories (ROMs) each uniquely associated with one of said print wheels for storing printing position decoding information for printing selected characters and for storing printing instructions associated with each of such characters at least some of said printing positions which are utilized in one ROM being different from another ROM so that substantially more printing positions than said maximum number is utilized; and switching means for enabling a selected one of said ROMs which corresponds to the associated print wheel placed in said printer.

2. A printer as in claim 1 which includes a feature panel and where said switching means includes a mechanical switch mounted on said feature panel.

3. A printer as in claim 1 where said printing instructions include print hammer intensity and ribbon increment information.

4. A printer as in claim 1 where said printing instructions include print hammer intensity and carriage displacement information.

* * * * *